United States Patent [19]

Martin et al.

[11] 4,411,279

[45] Oct. 25, 1983

[54] SMOKING PRODUCT AND PROCESS FOR MANUFACTURING SAME

[75] Inventors: Julian R. Martin, Winston-Salem; Larry W. Sides, Welcome, both of N.C.

[73] Assignee: R. J. Reynolds Tobacco Company, Winston-Salem, N.C.

[21] Appl. No.: 324,753

[22] Filed: Nov. 25, 1981

Related U.S. Application Data

[62] Divison of Ser. No. 155,876, Jun. 2, 1980, Pat. No. 4,326,543.

[51] Int. Cl.[3] ..... A24C 5/56; A20C 5/58

[52] U.S. Cl. ..... 131/94; 131/90; 131/91; 131/92; 131/93; 131/95

[58] Field of Search ..... 131/94, 95, 362, 90–93

[56] References Cited

U.S. PATENT DOCUMENTS

| | | | |
|---|---|---|---|
| 3,245,931 | 4/1966 | Matthew | 260/28.5 |
| 3,294,722 | 12/1966 | Apikos et al. | 260/28.5 |
| 3,306,882 | 2/1967 | Pullen et al. | 260/28.5 |
| 3,420,243 | 1/1969 | McArthur | 131/94 |
| 3,526,233 | 9/1979 | McArthur | 131/94 |
| 3,933,159 | 1/1976 | Molins | 131/94 |
| 4,236,535 | 12/1980 | Schmidt et al. | 131/94 |
| 4,262,680 | 4/1981 | Hinzmann | 131/94 |

OTHER PUBLICATIONS

World Tobacco, No. 62 (Oct. 1978), pp. 196–197.
World Tobacco, No. 63 (Jan. 1979), p. 101.
World Tobacco, No. 64 (Apr. 1979), pp. 93, 95–97 and 99–101.

*Primary Examiner*—V. Millin
*Attorney, Agent, or Firm*—Herbert J. Bluhm

[57] ABSTRACT

Filter-tipped cigarettes, cigars and similar smoking products which employ self-supporting non-wrapped fibrous filters are disclosed wherein the tobacco-containing portions are attached to the fibrous filters by tipping paper that is coated in a specified manner with a hot-melt adhesive.

14 Claims, No Drawings

SMOKING PRODUCT AND PROCESS FOR MANUFACTURING SAME

This application is a division of application Ser. No. 155,876 filed June 2, 1980, now U.S. Pat. No. 4,326,543 issued Apr. 27, 1982.

TECHNICAL FIELD

This invention relates to the manufacture of filter-tipped cigarettes, cigars or similar smoking products which employ self-supporting non-wrapped filters formed from filamentary materials.

BACKGROUND ART

Self-supporting non-wrapped filters prepared from filamentary materials such as cellulose acetate have been known for many years as indicated, for example, by U.S. Pat. Nos. 2,688,380, 3,079,930, 3,111,702, 3,190,294, 3,313,306 and 3,361,137. Although such filters are capable of providing economic benefits due to the elimination of the paper wrap that is normally used in the manufacture of fibrous filter rods, non-wrapped fibrous filters have not enjoyed appreciable commercial acceptance due largely to adhesion problems associated with attachment of the filter rod to a tobacco rod by conventional techniques currently used in the art. These conventional techniques involve the use of tipping paper coated with aqueous adhesives. When such techniques are used in the manufacture of filter cigarettes incorporating non-wrapped fibrous filters, a satisfactory product may be obtained at low production rates (i.e., rates of about 1,000 to 1,500 filter cigarettes per minute), but the product becomes totally unsatisfactory as production rates increase to the 4,000 cigarettes per minute and higher levels associated with present day cigarette manufacturing machines. Thus, the degree of success which has been achieved by non-wrapped fibrous filters has been confined, for the most part, to the production of multiple filters wherein a non-wrapped fibrous filter is joined to one or more other components by means of a combining wrap to form a composite wrapped filter. The combining wrap in composite filters eliminates the adhesion problems associated with non-wrapped fibrous filters but it also nullifies one of the principal economic benefits to be derived from non-wrapped filters, namely, the savings associated with elimination of the paper wrap.

Apart from the savings realized by eliminating the paper wrap from fibrous filter plugs, it is apparent that non-wrapped fibrous filters can also provide advantages in the manufacture of ventilated filter cigarettes. These potential advantages of the non-wrapped fibrous filters, however, have not led to their significant use in the manufacture of ventilated filter cigarettes due, again, to the adhesion problems associated with attachment of the filter rod to a tobacco rod with tipping paper. Indeed, the adhesion problems become even more acute if an adhesive-free zone is used in the area surrounding the ventilation openings in the tipping paper that is employed to attach the filter rod to the tobacco rod.

The adhesion problems relating to non-wrapped fibrous filters have been a factor in the development of various alternative techniques for manufacturing ventilated fibrous filter cigarettes. The most widespread technique used to date employs a perforated tipping paper in combination with a filter plug wrap that is highly porous. The inherent porosity of the paper used for wrapping the filter plug is sufficiently great so that it will not be a limiting factor in the degree of air dilution achieved by the filter plug wrap/perforated tipping paper combination. A similar arrangement involves the use of a relatively non-porous filter plug wrap that is provided with an excessive number of perforations which underlie the perforations in the tipping paper. In order to avoid obstruction of the perforations in the tipping paper with adhesive, an adhesive-free zone is ordinarily provided in the area surrounding the perforations. This leads, however, to an unsealed portion of the seam which joins the overlapping ends of the tipping paper and provides an unwanted path for additional air to be admitted into the fibrous core of the filter. Elimination of this unwanted path necessitates the application of a narrow strip of adhesive along the seam edge of the tipping paper by means of a carefully timed device which must be maintained precisely in registration with each cut segment of tipping paper. Consequently, one of the major disadvantages of this method is the great difficulty in obtaining consistent application of adhesive to the tipping paper at high production rates in order to achieve a uniform degree of ventilation in the resulting product.

The fact that adhesives used for attaching tipping paper to filter plugs can obstruct the ingress of dilution air forms the basis of another technique that has been proposed for manufacturing ventilated fibrous filter cigarettes. This technique employs inherently porous tipping paper in combination with porous filter plug wrap and the degree of ventilation is controlled by predetermined adhesive-free zones between the tipping paper and filter plug wrap. This method of air dilution is also not completely successful due to difficulty in achieving uniform porosities in both the tipping paper and filter plug wrap and to problems associated with the patterned application of aqueous adhesives to the tipping paper. Also, the porous tipping paper allows adhesive to bleed through the paper and leads to build-up of adhesive on machine parts contacted by the assembled filter cigarettes. This requires deposition of a barrier film to the tipping paper prior to application of the adhesive which adds to manufacturing costs and introduces an additional variable that must be carefully controlled in order to achieve a uniform degree of air dilution in the finished product.

Yet another approach to manufacturing ventilated fibrous filter cigarettes involves the introduction of perforations into the tipping paper and filter plug wrap after the filter rod has been attached to the tobacco rod. The perforations may be mechanically introduced by rolling the assembled filter cigarette along a predetermined path that is provided with needle-like elements which perforate the tipping paper and filter plug wrap circumferentially with the desired number of perforations appropriately located. Typical apparatus for mechanically perforating assembled cigarettes is disclosed in U.S. Pat. No. 4,140,137. Alternatively, the perforations may be formed by a suitable laser beam technique such as that described in U.S. Pat. No. 4,121,595. While these perforating methods largely avoid the problem of adhesive blockage of the perforations, the methods are not without their disadvantages. The use of needle-like elements, for example, leads to unacceptable variation in the size of the perforations due to rapid erosion of the elements under the conditions of use. Frequent replacement of the needle-like elements is, therefore, required and this results in periodic removal from service of the production apparatus while repairs are made. The laser perforating system, on the other hand, is capable of maintaining a high degree of uniformity in the formed perforations; however, present experience indicates that frequent servicing of the system is required apparently due to vaporized filter materials and degradation products which tend to condense on the focusing lenses of the laser system and other parts of the apparatus.

In spite of the considerable promise associated with non-wrapped fibrous filters and particularly to the use of such filters in ventilated filter cigarette products, it is clear that adhesion problems relating to their use have prevented significant commercial use of non-wrapped fibrous filters. These problems have, in fact, prompted those skilled in the art to seek alternative forms of fibrous filter cigarettes which are often more costly to produce or which have deficiencies in quality or performance as compared with non-wrapped fibrous filter cigarettes.

DISCLOSURE OF INVENTION

The present invention is concerned with the manufacture of a smoking product which incorporates therein a non-wrapped fibrous filter. The preparation of this product is particularly suited to the high speed manufacture of filter cigarettes although it may also be used for other filter-tipped smoking products such as cigarillos or cigars. The manufacturing process used in accordance with this invention is characterized by a high efficiency (i.e., a low percentage of rejected products) and the apparatus required for the manufacturing process is readily available.

Basically, the invention involves the use of tipping paper having a hot-melt adhesive applied thereto for joining together a tobacco rod and a non-wrapped fibrous filter. The non-wrapped fibrous filter contemplated for use with this invention include those based on cellulose, polyolefins, polyamides, polyesters as well as derivatives thereof. The fibrous filters may have a relatively smooth annular sheath of coalesced fibers although it is preferred that the filters have an embossed peripheral surface such as that described in U.S. Pat. No. 3,313,306. It has been discovered that if certain criteria are met, satisfactory adhesion between the tipping paper and the non-wrapped fibrous filters can be achieved even at production rates in excess of 4,000 cigarettes per minute.

The first criterion is that the hot-melt adhesive must cover at least 30 percent and preferably at least 45 percent (as hereinafter defined) of the surface area of the side of the tipping paper that will be in contact with the fibrous filter plug and the tobacco rod. Secondly, the quantity of hot-melt adhesive applied to the tipping paper must be at least 10 grams per square meter and preferably at least 13 g/m$^2$ and should not exceed 60 grams per square meter (as hereinafter defined) with the combined thickness of the tipping paper and the hot-melt adhesive coating applied thereto not to exceed 125 microns and preferably, not to exceed 100 microns. Finally, the thickness of the hot-melt adhesive coating on the tipping paper must be at least 8 microns and preferably should be at least 12 microns.

If the foregoing criteria are satisfied, the present invention will provide a product of exceptional quality at production rates of up to 5,000 filter cigarettes per minute and more with an acceptably low product rejection rate due to faulty adhesion of the tipping paper.

DESCRIPTION OF PREFERRED EMBODIMENTS

In accordance with one preferred embodiment of the present invention, tipping paper that is substantially nonporous is coated with a hot-melt adhesive. The hot-melt adhesive may be applied by various techniques known in the art such as extrusion coating, curtain coating, reverse roll coating, slot coating and rotogravure coating. Regardless of the coating technique used, it is essential that at least 30 percent and preferably at least 45 percent of the surface area of the tipping be coated with the hot-melt adhesive. The adhesive may be applied to the web of tipping paper as it is fed from a supply bobbin to the filter tipping operation as described, for example, in U.S. Pat. No. 3,933,159 or the web of tipping paper may be coated with adhesive in a separate operation and stored temporarily in bobbin form for later use in the tipping operation.

For the purposes of this disclosure and the appended claims, the specified percentages of the tipping paper surface area that is coated with adhesive as well as the quantities of adhesive applied per square meter of surface area are based on the actual surface area that is coated. Thus, tipping paper coated with a series of parallel lines of adhesive wherein each adhesive line and each uncoated area between adjacent lines of adhesive involve the same amount of tipping paper surface area would be regarded as having a coating over 50 percent of its surface area. Also, the specified quantity of adhesive in grams per square meter of tipping paper surface area in that case would be based on one half of the total surface area of the tipping paper. Similarly, tipping paper having an adhesive coating applied by a slot coater over 80 percent of its surface area would have adhesive quantities specified on the basis of 80 percent of the total surface area of the tipping paper.

The quantity of hot-melt adhesive applied to the web of tipping paper must be carefully controlled to insure that at least 10 g/m$^2$ is deposited on the paper. The actual quantity applied to the paper will depend to some extent on the coating technique used, the surface texture of the tipping paper and the proportion of the surface area that is coated. Application of excessive amounts of adhesive is to be avoided. Generally, the amounts applied should not exceed approximately 60 g/m$^2$. Regardless of the coating technique used, the minimum thickness of the hot-melt adhesive coating applied to the tipping paper must be at least 8 microns and, preferably, should be at least 12 microns. Moreover, the maximum thickness of the tipping paper together with the hot-melt adhesive deposited on the paper should be 125 microns and, preferably, should be 100 microns or less. This is important because it has been found that excessive thickness of paper plus adhesive increases the time required for adequate heat transfer and may result in incomplete activation of the adhesive when the filter tipping operation is conducted at high production rates.

The characteristics of the hot-melt adhesive are also important factors in the practice of this invention. For the purposes of this invention a hot-melt adhesive is defined as an adhesive containing two or more major (i.e., at least 5 percent by weight of the formulation) ingredients, including a thermoplastic polymer, said adhesive being capable of becoming sufficiently fluid at elevated temperatures to "wet" substrates contacted therewith and of resolidifying upon cooling to effect adhesive bonds with the contacted substrates. The activation temperature of the adhesive selected (i.e., the temperature at which it becomes sufficiently fluid to "wet" substrates) is preferably in the range of about 60° to 110° C. The adhesive must have good hot tack, preferably in the 60° to 110° C. temperature range, and should set quickly upon cooling.

The viscosity of the hot-melt adhesive is not critical as far as adhesion of the tipping paper to the fibrous filter and tobacco rod is concerned; however, the coating technique to be used may influence the selection of the adhesive as far as viscosity is concerned. Thus, the Brookfield viscosities (as determined at 177° C. using a No. 28 spindle and rotational speed of 20 r.p.m.) that can be accommodated by slot coating or reverse roll coating techniques cover a rather wide range of about 2,000 to 100,000 centipoise but best results are obtained if adhesives with viscosities of 10,000 to 20,000 cp. are used. Similarly, rotogravure coating is limited to a range of about 1,500 to 8,000 centipoise with viscosities of 3,000 to 6,000 being preferred. Curtain coating requires viscosities of about 8,000 to 15,000 centipoise and extrusion coating requires adhesive viscosities of about 25,000 to 100,000 centipoise with the 25,000 to 40,000 centipoise range being preferred.

The hot-melt adhesives used with this invention are preferably nonsolvent formulations (i.e., they do not include relatively volatile solvents such as toluene, trichloroethane, methyl isobutyl ketone, etc.). Suitable formulations have been described in the prior art and some are available commercially. A particularly preferred formulation is based on a copolymer of ethylene and vinyl acetate combined with a wax and a polymeric resin formed from styrene and/or a styrene derivative. Typical formulations are described in U.S. Pat. Nos. 3,245,931, 3,294,722, 3,306,882, 3,401,131, 3,401,132 and 3,429,843. For example, 25 to 35 parts by weight of an ethylene/vinyl acetate copolymer containing approximately 24–30 percent vinyl acetate are blended with 20 to 30 parts by weight of a resin formed by copolymerizing $\alpha$-methylstyrene and vinyltoluene and 30 to 55 parts by weight of paraffin wax having a melting point in the range of 50° C. to 95° C. The melt index of the ethylene/vinyl acetate copolymer selected should be no greater than 20 and, preferably, is 12 or less. A portion of the paraffin wax may be replaced by microcrystalline wax (m.p. 70°–95° C.). if desired, and the blended adhesive formulation may also include low levels of special additive, such as antioxidants. Other hot-melt adhesive formulations may also be used provided that such adhesives exhibit the desired characteristics described above.

If the filter cigarette manufacturing operation will require temporary storage of adhesive-coated tipping paper in bobbin form, consideration must also be given to the problem of "blocking" which occurs when successive layers of adhesive-coated tipping paper become adhered. As a rule, hot-melt formulations exhibiting a "blocking" temperature of about 45° C. and above will be acceptable. Expressed in another way, bobbins of adhesive-coated tipping paper which do not display a tendency to "block" at temperatures below 45° C. are desired.

After the hot-melt adhesive has been applied to the tipping paper, the adhesive-coated tipping paper is used to combine a non-wrapped fibrous filter rod to a tobacco rod. Apparatus for assembling filter cigarettes is known and is disclosed, for example, in U.S. Pat. Nos. 3,420,243, 3,526,233 and 3,933,159. The temperatures required for the tipping operation will, of course, be determined by a number of factors including the activation temperature of the hot-melt adhesive being used, the heat transfer characteristics of the tipping paper and adhesive, the speed of the combining operation and the surface characteristics of the fibrous filter rod. The optimum operating temperatures can be readily established with a minimum of experimentation. It should be noted that temperatures of the elements which heat the adhesive-coated tipping paper can exceed the activation temperature of the adhesive by a considerable margin due to the fact that the residence time of each filter cigarette in the assembling apparatus is quite short.

In accordance with the foregoing description the filter-tipped smoking product of this invention can be manufactured from a rod-shaped wrapped section of tobacco, a rod-shaped non-wrapped fibrous filter and a web of tipping paper by a process which comprises:

(a) applying to at least 30 percent of the surface area on one side of the web of tipping paper between 10 and 60 grams of a hot-melt adhesive per square meter of said surface area actually coated, the quantity of adhesive applied to said surface area being sufficient to provide an adhesive coating thickness of at least 8 microns and the combined thickness of the tipping paper and adhesive coating applied thereto being no more than 125 microns, (b) cutting the adhesive-coated tipping paper into segments of predetermined length, (c) moving the wrapped section of tobacco and the non-wrapped fibrous filter into abutting, axial alignment, (d) heating the adhesive-coated segment of tipping paper sufficiently to activate the adhesive and bringing the adhesive-coated side thereof into contact with the non-wrapped fibrous filter and the abutting end of the section of tobacco, (e) wrapping the segment of tipping paper coated with the heat-activated adhesive in sealing engagement around the non-wrapped fibrous filter and the abutting end of the section of tobacco so that substantially the entire length of the filter and the abutting end of the section of tobacco are circumferentially enveloped by the tipping paper, and (f) maintaining the wrapped segment of tipping paper in sealing engagement with the non-wrapped fibrous filter and the abutting end of the section of tobacco for a sufficient time period to permit cooling and setting of the heat-activated adhesive in the assembled filter-tipped smoking product.

In a further embodiment of the present invention which is especially preferred, ventilated or air-diluted filter cigarettes are produced using a non-wrapped fibrous filter surrounded by tipping paper that is substantially non-porous and that has been coated with a hot-melt adhesive. In this embodiment the tipping paper is provided with perforations either before or after assembly of the filter cigarette. Perforations can be introduced into the tipping paper on an assembled cigarette using mechanical means such as a rolling action across a surface provided with short pins (see, for example, U.S. Pat. No. 4,140,137) or laser means such as those described in U.S. Pat. No. 4,121,595. It is preferred, however, that the perforations be introduced into the tipping paper prior to attachment to the filter and tobacco rod. It has been found that perforations so introduced are sufficiently uniform, particularly when laser or electrostatic perforating techniques are used, that the degree of ventilation in filter cigarettes manufactured from the perforated tipping paper falls within an acceptable narrow range.

In the preparation of a perforated and adhesive-coated web of tipping paper, the adhesive may be applied as a pattern which leaves an adhesive-free zone in the portion of the tipping paper that is to be perforated. For example, adhesive may be applied by rotogravure techniques to selected areas of the tipping paper web so that individual rectangular patches cut therefrom and wrapped around the filter/tobacco rod assembly will have approximately 4 mm. wide adhesive-coated areas along three of the edges and an 8 mm. wide area along the remaining edge which partially overlies the tobacco rod. The preferred method, however, involves rotogravure application of an adhesive pattern which extends over the entire surface area of the tipping paper. Suitable patterns may be applied, for example, by gravure cylinders having mechanically or chemically engraved cells or recesses on the surface thereof. The adhesive-coated paper is then perforated by a spark discharge device to give the desired perforations. Laser or mechanical perforating techniques can also be used to introduce perforations into the adhesive coated web of tipping paper.

In connection with the manufacture of ventilated filter cigarettes according to the presently disclosed invention, it should be noted that non-wrapped fibrous filters having an impervious sheath on their outer periphery are generally unsuitable for use unless the impervious sheath is first provided with sufficient perforations to permit dilution air to enter into the central core of the filter. Most of the previously disclosed manufacturing processes for the production of self-supporting, non-wrapped fibrous filters result in fusion of the fibers only at the points of contact so that a large number of pathways remain for the ingress of dilution air into the filter core. For the purposes of the presently disclosed invention and claims involving tipping paper provided with means for permitting the passage of air through the paper, it is intended that the term "non-wrappped fibrous filter" include not only fibrous filters with an inherently porous peripheral surface but also fibrous filters with an impervious sheath that has been provided with perforations.

The following examples will serve to illustrate further various preferred embodiments of this invention.

EXAMPLE 1

A non-wrapped cellulose acetate filter rod (available commercially from American Filtrona Corporation of Richmond, Va. under the designation "NWA" filter) was cut into double lengths for attachment to cigarettes using a P.A.8 Plug Assembling Machine manufactured by Molins Limited of London, England. A non-porous tipping paper (cork base MR-370 buff tone obtained from the Schweitzer Division of Kimberly-Clark Corporation, Newark, N.J.) was coated in a separate operation with Proxmelt E4030 hot-melt adhesive available from Pierce & Stevens Chemical Corporation of Buffalo, N.Y. Approximately 13.8 grams of adhesive per square meter of tipping paper was applied by extrusion coating techniques well known in the art to give tipping paper having one side thereof entirely coated with the hot-melt adhesive. The combined thickness of the tipping paper and adhesive coating was approximately 58 microns.

The P.A.8 machine was operated in the normal manner at a production rate of 4,000 cigarettes per minute except that the means for applying aqueous adhesive to the tipping paper were not used because the tipping paper had already been provided with a coating of hot-melt adhesive in a separate operation as noted above. The adhesive was actuated by heating it to about 80° C. in connection with the combining of the filter and tobacco rods. A visual inspection of the filter cigarettes produced by this assembling operation revealed excellent uniformity of the adhesive bond between the tipping paper and the NWA filter/cigarette combination. Moreover, the percentage of cigarettes rejected due to defective seals involving the tipping paper was no greater than the approximate two percent rejection rate associated with the production of conventional filter cigarettes on the P.A.8 using aqueous adhesives and paper-wrapped cellulose acetate filter rods.

EXAMPLE 2

The procedure of Example 1 was repeated except that approximately 14.7 g/m$^2$ of the adhesive was applied to a white tipping paper (MR-661) obtained from the Schweitzer Division of Kimberly-Clark Corporation to give a combined thickness of about 58 microns. The resulting filter cigarettes were characterized by excellent adhesive seals associated with the tipping paper and the proportion of cigarettes deemed to be unacceptable due to defects involving the filter tip end of the cigarette was estimated to be less than three percent.

EXAMPLE 3

The procedure of Example 2 was repeated except that approximately 26.1 g/m$^2$ of hot-melt adhesive was applied to the tipping paper by a rotogravure process using a specially formulated adhesive containing approximately 30 parts by weight ethylene/vinyl acetate (27–29% vinyl acetate content, melt index 3), approximately 25 parts by weight Piccotex 120 (an $\alpha$-methylstyrene/vinyl toluene copolymer available from Hercules, Inc. of Wilmington, Del.), approximately 40 parts by weight paraffin wax (m.p. 63° C.), approximately 5 parts by weight microcrystalline wax (m.p. 77° C.) and approximately 0.4 part butylated hydroxytoluene. A gravure cylinder having a quadrangular pattern on the surface thereof was used for applying to the tipping paper a pattern of spaced dots of adhesive so that approximately 65 percent of the surface area on the tipping paper was coated with adhesive and the maximum combined thickness of the adhesive and paper was approximately 76 microns. The filter cigarettes produced were very acceptable and the number rejected due to defects associated with the filter tip end constituted less than about three percent of the cigarettes produced by the P.A.8 machine.

EXAMPLE 4

The procedure of Example 1 was repeated except that the adhesive-coated tipping paper was subjected to an additional processing step wherein perforations were introduced into the adhesive-coated tipping paper by laser means. The perforated and adhesive-coated tipping paper was then used to manufacture filter cigarettes on the P.A.8 machine with the percentage of defective cigarettes again being at an acceptable low level.

EXAMPLE 5

The procedure of Example 3 was repeated except that 32.6 g/m$^2$ of the adhesive was applied to Schweitzer MR-370 tipping paper by a gravure cylinder having a trihelical pattern on the surface of the cylinder to introduce onto the tipping paper a succession of parallel lines of adhesive diagonally oriented with respect to the edges of the tipping paper and spaced so that about 50 percent of the surface area remained uncoated. The maximum combined thickness of the hot-melt adhesive and the tipping paper was about 94 microns. Perforations were also introduced into the adhesive-coated tipping paper by means of a spark discharge device. The perforated and coated tipping paper was then used on the P.A.8 machine to manufacture ventilated filter cigarettes. Less than five percent of the filter cigarettes produced were found to have defective adhesive seals involving the tipping paper.

EXAMPLE 6

The procedure of Example 5 was repeated except that 43 g/m$^2$ of the hot-melt adhesive was applied to the tipping paper to give a combined thickness of approximately 102 microns and the non-wrapped cellulose acetate filter rod used was formed from 4.2 denier per filament/40,000 total denier cellulose acetate tow by using the general method described in U.S. Pat. No. 3,313,306. Less than three percent of the ventilated filter cigarettes produced were found to have defects relating to the tipping paper seal.

EXAMPLE 7

The procedure of Example 1 was repeated except that a special design non-wrapped cellulose acetate filter designated "SCS III" by American Filtrona Corporation was attached to the cigarette by white tipping paper (Schweitzer MR-661) coated with 17.1 g/m$^2$ of the hot-melt adhesive and having a combined paper-/adhesive thickness of about 64 microns. The assembled filter cigarettes were subjected to an additional processing step wherein a number of perforations were introduced into the tipping paper by rolling the cigarette across a surface provided with needle-like projections. The resulting ventilated filter cigarettes had acceptable filter tips and less than five percent of the filter cigarettes produced were rejected due to faulty adhesive seals involving the tipping paper.

EXAMPLE 8

The procedure of Example 2 was repeated except that 19.4 g/m$^2$ of the hot-melt adhesive was applied to the white tipping paper by a Park slot coater wherein two longitudinally disposed areas each 4 mm. in width were left uncoated to give an adhesive coating over 88 percent of the surface area of the tipping paper (combined thickness about 64 microns) and the coated paper was subjected to a further processing step in which perforations were introduced into the uncoated areas of the tipping paper by a mechanical perforator. The uncoated areas with the perforations were located an appropriate distance from each edge of the web of tipping paper so that two filter cigarettes produced by wrapping the tipping paper around a "double length" filter rod and cutting resulted in each of the uncoated and perforated areas being arranged circumferentially on the filter tip end of a finished cigarette. Less than three percent of the assembled cigarettes were found to have unacceptable adhesive seals associated with the tipping paper.

EXAMPLE 9

The procedure of Example 8 was repeated except that 23.7 g/m$^2$ of a hot-melt adhesive containing approximately 30 parts by weight ethylene/vinyl acetate (27–29% vinyl acetate content, melt index 3), approximately 25 parts by weight Piccotex 120, approximately 36 parts by weight paraffin wax (m.p. 75° C.), approximately 9 parts by weight microcrystalline wax (m.p. 88° C.) and approximately 0.1 part butylated hydroxytoluene was applied to the tipping paper with two longitudinally disposed 7-mm. wide areas being left uncoated. The adhesive coating covered approximately 80 percent of the total surface area of the tipping paper and the combined paper/adhesive thickness was about 65 microns. The two 7-mm. wide uncoated areas were perforated by spark discharge means. Less than five percent of the ventilated filter cigarettes produced were deemed to have defective adhesive seals involving the tipping paper.

EXAMPLE 10

A rotogravure cylinder provided with a quadrangular pattern of "cells" was used to apply to a non-porous tipping paper (MR-370A obtained from Schweitzer Division of Kimberly-Clark Corporation) 21.4 g/m$^2$ of a hot-melt adhesive containing approximately 25 parts by weight Piccotex 120, approximately 30 parts by weight ethylene/vinyl acetate (27–29% vinyl acetate content, melt index 3), approximately 45 parts by weight paraffin wax (m.p. 68° C.) and about 0.1 part by weight butylated hydroxytoluene. Approximately 65 percent of the tipping paper surface area was coated with adhesive and the maximum combined thickness of adhesive and paper was about 76 microns. The adhesive-coated tipping paper was then used to attach non-wrapped cellulose acetate filter rods ("NWA" filters from American Filtrona Corporation) to tobacco rods on a 6-8-6 filter cigarette machine obtained from Hauni-Werke, Korber & Co. KG, of Hamburg-Bergedorf, Germany. The filter cigarette machine had been previously modified in accordance with U.S. Pat. No. 3,420,243 to permit the use of tipping paper coated with hot-melt adhesive. The modified 6-8-6 machine was operated at a production rate of about 2,000 cigarettes per minute to give filter cigarettes with acceptable adhesive seals associated with the tipping paper.

EXAMPLE 11

The procedure of Example 10 was repeated except that approximately 14.67 g/m$^2$ of a hot-melt adhesive containing approximately 17.5 parts by weight ethylene/vinyl acetate (27–29% vinyl acetate content, melt index 6), approximately 17.5 parts by weight ethylene/vinyl acetate (24–26% vinyl acetate content, melt index 2), approximately 25 parts by weight Piccotex 120, approximately 31 parts by weight paraffin wax (m.p. 74° C.), approximately 8 parts by weight microcrystalline wax (m.p. 88° C.), approximately 1 part by weight butyl rubber and approximately 0.5 part by weight butylated hydroxytoluene was applied over the entire surface area by curtain-coating techniques to give an adhesive-coated tipping paper with a combined adhesive/paper thickness of approximately 58 microns. The filter cigarettes produced at the rate of about 2,000 per minute had very satisfactory adhesive seals involving the tipping paper.

EXAMPLE 12

The procedure of Example 8 was repeated except that 49 g/m$^2$ of a hot-melt adhesive containing approximately 30 parts by weight ethylene/vinyl acetate (27–29% vinyl acetate content, melt index 6), approximately 25 parts by weight Piccotex 120, approximately 36 parts by weight paraffin wax (m.p. 75° C.), approximately 9 parts by weight microcrystalline wax (m.p. 88° C.) and approximately 0.1 parts butylated hydroxytoluene was applied to the tipping paper by the slot coater to give a maximum combined paper/adhesive thickness of about 114 microns. The resulting filter cigarettes exhibited satisfactory adhesive seals with an acceptably low proportion of the assembled cigarettes being rejected due to defects involving the filter tip end of the cigarette.

EXAMPLE 13

The filter tip ends of the assembled ventilated filter cigarettes produced in Example 6 were subjected to draft analysis in order to evaluate the uniformity of the degree of ventilation introduced by the perforated tipping and any incomplete sealing along the seam formed by the overlapping tipping paper. Fifty cigarettes were selected at random from the test run and the tobacco rods were carefully removed so that the filters and perforated tipping adhered thereto remained intact. The draft resistance of each intact filter assembly was then measured by a draft gauge at a standard flow rate of 17.5 cc/min. using techniques well known in the art. The sample holder on the draft gauge permitted the filters to be fully inserted so that a measurement could be made with the perforations in the tipping paper covered by the encapsulating gland of the sample holder. With the tipping paper perforations completely covered by the sample holder gland, it was found that the draft measurements for the 50 filter assemblies ranged from 55 to 76 mm. of water with a mean value of 65.7 and a standard deviation of 4.2 Similar measurements of the same filters but with the filters inserted in the sample holder so that the tipping paper perforations remained uncovered resulted in draft values ranging from 51 to 71 mm. of water with a mean of 61.5 and a standard deviation of 3.8. These data indicate that there is a certain degree of non-uniformity inherent in the non-wrapped cellulose acetate filter rods as evidenced by the range of the draft values and standard deviation associated with the filters when the tipping paper perforations were covered by the same holder. More importantly, the data show that there was no increase in the standard deviation due to the perforations in the tipping paper or to the adhesive seal along the overlap seam of the tipping paper.

What is claimed is:

1. A process for manufacturing a filter-tipped smoking product from a rod-shaped wrapped section of tobacco, a rod-shaped non-wrapped fibrous filter and a web of tipping paper which comprises:

(a) applying to at least 30 percent of the surface area on one side of the web of tipping paper between 10 and 60 grams of a hot-melt adhesive per square meter of said surface area actually coated, the quantity of adhesive applied to said surface area being sufficient to provide an adhesive coating thickness of at least 8 microns and the combined thickness of the tipping paper and adhesive coating applied thereto being no more than 125 microns, (b) cutting the adhesive-coated tipping paper into segments of predetermined length, (c) moving the wrapped section of tobacco and the non-wrapped fibrous filter into abutting, axial alignment, (d) heating the adhesive-coated segment of tipping paper sufficiently to activate the adhesive and bringing the adhesive-coated side thereof into contact with the non-wrapped fibrous filter and the abutting end of the section of tobacco, (e) wrapping the segment of tipping paper coated with the heat-activated adhesive in sealing engagement around the non-wrapped fibrous filter and the abutting end of the section of tobacco so that substantially the entire length of the filter and the abutting end of the section of tobacco are circumferentially enveloped by the tipping paper, and (f) maintaining the wrapped segment of tipping paper in sealing engagement with the non-wrapped fibrous filter and the abutting end of the section of tobacco for a sufficient time period to permit cooling and setting of the heat-activated adhesive in the assembled filter-tipped smoking product.

2. The process of claim 1 wherein said hot-melt adhesive is capable of being activated at temperatures within the range of 60°–110° C.

3. The process of claim 1 wherein the non-wrapped fibrous filter comprises cellulose acetate.

4. The process of claim 1 wherein the tipping paper is provided with means for permitting the passage of air through the paper.

5. The process of claim 1 wherein at least 45 percent of said one side of the web of tipping paper is coated with between 13 and 60 g/m$^2$ of the hot-melt adhesive to provide and adhesive coating thickness of at least 12 microns.

6. The process of claim 1 wherein the tipping paper is substantially non-porous and said process includes the additional step of perforating the tipping paper after the step of applying hot-melt adhesive thereto and before cutting the adhesive-coated tipping paper into segments.

7. The process of claim 6 wherein the step of perforating the tipping paper involves the use of mechanical, laser or electrostatic perforating means.

8. A process for manufacturing a filter-tipped cigarette from a generally cylindrical wrapped section of tobacco and a generally cylindrical non-wrapped fibrous filter having a cross-sectional dimension similar to said section of tobacco comprising (a) providing a web of tipping paper having a coating on one side of said tipping paper of between 13 and 60 grams of a hot-melt adhesive per square meter of tipping paper surface area actually coated, said hot-melt adhesive being capable of being activated at temperatures between 60° and 110° C. and said tipping paper being further characterized as having at least 45 percent of the surface area of said one side of the tipping paper coated with a sufficient quantity of said adhesive to provide an adhesive coating thickness of at least 12 microns with the combined thickness of the tipping paper and the adhesive coating applied thereto not exceeding 125 microns, (b) cutting the adhesive-coated tipping paper into segments of predetermined length, (c) moving the wrapped section of tobacco and the non-wrapped fibrous filter into abutting, axial alignment, (d) heating the adhesive-coated segment of tipping paper sufficiently to activate the adhesive and bringing the heat-activated adhesive into contact with the non-wrapped fibrous filter and the abutting end of the section of tobacco, (e) wrapping the segment of tipping paper coated with the heat-activated adhesive in sealing engagement around the non-wrapped fibrous filter and the abutting end of the section of tobacco so that substantially the entire length of the filter and the abutting end of the section of tobacco are circumferentially enveloped by the tipping paper, and (f) maintaining the wrapped segment of tipping paper in sealing engagement with the non-wrapped fibrous filter and the abutting end of the section of tobacco for a sufficient time period to permit cooling and setting of the heat-activated adhesive in the assembled filter-tipped cigarette.

9. The process of claim 8 wherein the non-wrapped fibrous filter comprises cellulose acetate.

10. The process of claim 8 wherein the hot-melt adhesive contains two or more ingredients including a thermoplastic polymer, each ingredient constituting at least 5 percent by weight of the hot-melt adhesive.

11. The process of claim 10 wherein the hot-melt adhesive contains an ethylene/vinyl acetate copolymer, a paraffin wax and a polymeric resin derived from styrene and/or a styrene derivative.

12. The process of claim 11 wherein the hot-melt adhesive comprises 25–35 parts by weight of an ethylene/vinyl acetate copolymer having a vinyl acetate content of 24 to 30 percent, 20–30 parts by weight of a vinyltoluene/$\alpha$-methylstyrene copolymer and 30 to 55 (percent) parts by weight of paraffin wax having a melting point in the range of 50°–95° C.

13. The process of claim 8 wherein the tipping paper is inherently non-porous and is provided with perforations formed by mechanical, laser or electrostatic means.

14. The process of claim 8 wherein the assembled filter-tipped cigarette is subjected to the additional step of introducing perforations into the portion of the tipping paper which overlies the non-wrapped fibrous filter.

* * * * *